United States Patent [19]

Knapp

[11] Patent Number: 4,741,316

[45] Date of Patent: May 3, 1988

[54] FUEL INJECTION SYSTEM

[75] Inventor: Heinrich Knapp, Leonberg, Fed. Rep. of Germany

[73] Assignee: Robert Bosch GmbH, Stuttgart, Fed. Rep. of Germany

[21] Appl. No.: 362,369

[22] Filed: Mar. 26, 1982

[30] Foreign Application Priority Data

Mar. 26, 1981 [DE] Fed. Rep. of Germany ..... 3111946

[51] Int. Cl.[4] ..... F02M 51/00; F02D 3/02

[52] U.S. Cl. ..... 123/494; 123/382

[58] Field of Search ..... 123/494, 341, 382, 389; 73/115, 116, 707

[56] References Cited

U.S. PATENT DOCUMENTS

| | | | |
|---|---|---|---|
| 3,490,424 | 1/1970 | Hoelle et al. | 123/494 |
| 3,566,847 | 3/1971 | Scholl et al. | 123/494 X |
| 3,712,275 | 1/1973 | Jackson | 123/494 |
| 4,377,145 | 3/1983 | Nagaishi | 123/494 |

FOREIGN PATENT DOCUMENTS

| | | | |
|---|---|---|---|
| 0152714 | 12/1979 | Japan | 123/382 |

*Primary Examiner*—Willis R. Wolfe, Jr.
*Attorney, Agent, or Firm*—Edwin E. Greigg

[57] ABSTRACT

A fuel injection system for internal combustion engines is proposed which serves to inject a quantity of fuel adapted to the aspirated air quantity. In the intake tube of the engine, an intake tube section downstream of a throttle valve communicates with an intake tube pressure sensor via a connecting line. The output signal of this intake tube pressure sensor affects the opening duration of the injection valves. In order to reduce the influence of pulsations on the measurement product of the intake tube pressure sensor, a throttle valve is provided which in the presence of the operational engine states of upper partial load and full load reduces the cross section of the connecting line.

5 Claims, 1 Drawing Sheet

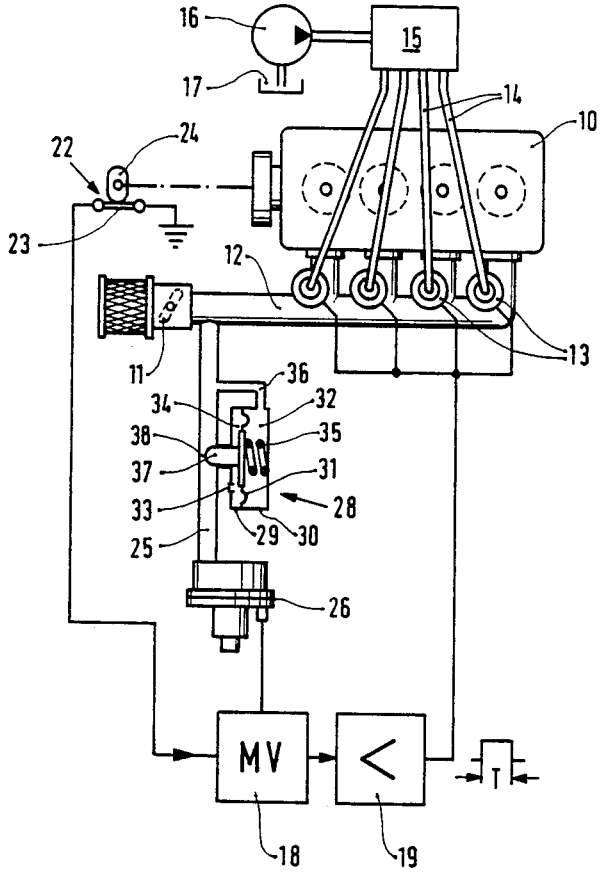
16
15
17
14
10
22
24
23
12
13
11
36
34
32
38
35
37
31
33
28
29
30
25
26
MV
<
T
18
19

FUEL INJECTION SYSTEM

BACKGROUND OF THE INVENTION

The invention is based on a fuel injection system of the general type described hereafter. A fuel injection system having a pressure sensor in the intake tube is already known; in this system, a pneumatic damping apparatus is provided in the intake tube pressure sensor in order to prevent errors in measurement caused by periodic pressure fluctuations in the intake tube of the internal combustion engine. However, this system has the disadvantage that a damping apparatus of this kind acts over the entire operating range of the engine, so that particularly in the partial-load range of the engine, pressure changes are detected by the intake tube pressure sensor only in a delayed manner.

OBJECT AND SUMMARY OF THE INVENTION

The fuel injection system according to the invention has the advantage over the prior art in, that the sensitivity of the intake tube pressure sensor is not reduced by damping over the entire measurement range; instead, it is possible to reduce the influence of pulsations on the measurement product of the intake tube pressure sensor only in the upper load range of the engine.

Advantageous further embodiments of and improvements to the fuel injection system disclosed in the main claim are attainable by means of the characteristics of the dependent claims.

The object will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows a schematic view of an exemplary embodiment of the invention in simplified form.

DESCRIPTION OF THE PREFERRED EMBODIMENT

The fuel injection system shown in the drawing serves for example to operate a four-cylinder, mixture-compressing internal combustion engine 10 which has externally-supplied ignition. In each of the four branching pipes of the intake tube section 12 disposed downstream of a throttle valve 11, there is an electromagnetically actuatable injection valve 13, close to the inlet valve (not shown) of the respective cylinder. Each injection valve 13 is connected via a fuel supply line 14 to a distributor container 15, which is supplied by a pump 16 with fuel from a fuel container 17. By means of a fuel pressure regulating valve (not shown), it is possible to maintain the fuel in the distributor container 15 under constant pressure, so that a predetermined opening duration of the injection valves always corresponds to a predetermined injected fuel quantity.

Each of the injection valves 13 includes an electromagnet, which opens the injection valve when excited. In order to control the injection valves 13, an electronic control unit is provided, substantially comprising a multivibrator 18 and an amplifier 19. The injection valves 13 are connected to the output of the amplifier 19. The multivibrator 18 is controlled by a pulse transducer 22, which comprises a contact 23 actuated by a means cam 24. The cam 24 is driven at the camshaft rpm of the engine, so that the multivibrator 18 emits two pulses, which open the injection valves 13, upon every rotation of the camshaft.

In order to make the duration T of the output pulses of the multivibrator 18 dependent on the intake tube pressure downstream of the throttle valve 11 in the intake tube section 12, an intake tube pressure sensor 26 is connected via a connecting line 25; its design and mode of operation are known and will therefore not be described again at this point.

Particularly in the upper partial-load range of the engine and at full load, air pulsations occur in the intake tube section 12, which adulterate the intake tube pressure valve ascertained by the intake tube pressure sensor 26. In accordance with the invention, a throttle valve 28 is accordingly disposed at the connecting line 15 between the intake tube section 12 and the intake tube pressure sensor 16; by means of this throttle valve 28, the cross section of the connecting line 25 can be varied in accordance with the load status of the engine. The throttle valve 28 has a control diaphragm 31 fastened between a first housing half 29 and a second housing half 30, which separates a control chamber 32 from an atmospheric chamber 34 ventilated to the atmosphere at 33. A compression spring 35 is disposed in the control chamber 32 and is supported at the other end on the control diaphragm 31. The control chamber 32 communicates via an underpressure line 36 with the intake tube pressure of the intake tube section 12. A control slide 37 is connected with the control diaphragm 31 remote from the control chamber 32. The other end of the control slide 37 protrudes into the connecting line 25 and, forming a variable throttle restriction 38 of a greater or lesser extent with the wall of the connecting line 25, opens the cross section of the connecting line 25 to a greater or lesser extent depending on the position of the control diaphragm 31. The throttle valve 28 is designed such that the control slide 37 opens the cross section of the connecting line 25, and thus the throttle restriction 38, as completely as possible at low and medium partial load of the engine; at upper partial-load and at full load of the engine, the control slide 37 is displaced into the connecting line 25 to such an extent that throttling occurs, which reduces the influence of pulsations in the intake tube section 12 on the measurement product of the intake tube pressure sensor 26.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines having an intake tube and a throttle device disposed therein, wherein the determination of the quantity of fuel to be injected is made in accordance with a sensor attached to an intake tube to sense pressure therein, said sensor being attached to said intake tube section downstream of said throttle device, characterized in that a connecting line is disposed between said intake tube section downstream of said throttle device and said intake tube pressure sensor and further that a throttle restriction the cross section of which is variable in accordance with said intake tube pressure is provided in said connecting line.

2. A fuel injection system as defined by claim 1, characterized in that said throttle restriction emanates from a housing provided with a control diaphragm which is exposed at one side to said intake tube pressure downstream of said throttle device and a compression spring and on the other side to atmospheric pressure.

3. A fuel injection system as defined by claim 2, characterized in that said control diaphragm varies the cross section of said throttle restriction.

4. A fuel injection system as defined by claim 2, characterized in that said throttle restriction comprises a control slide which is displaced by said control diaphragm transversely into said connecting line to a greater or lesser extent.

5. A fuel injection system as defined by claim 2, characterized in that said cross-sectional control of the variable throttle restriction is effected such that the cross section is large in the operational engine statuses of lower and medium partial load, while at upper partial-load and full load this cross section is reduced.

* * * * *